United States Patent [19]

Huber

[11] 4,444,450

[45] Apr. 24, 1984

[54] FLAT TRANSMISSION CABLE CONNECTOR AND HOUSING THEREFOR

[75] Inventor: John H. Huber, Harrisburg, Pa.

[73] Assignee: AMP Incorporated, Harrisburg, Pa.

[21] Appl. No.: 343,630

[22] Filed: Jan. 28, 1982

[51] Int. Cl.[3] ..... H01R 13/58

[52] U.S. Cl. ..... 339/107; 339/91 R

[58] Field of Search ..... 339/17 F, 176 MF, 176 M, 339/184 M, 186 M, 91 R, 105, 107

[56] References Cited

U.S. PATENT DOCUMENTS

| | | | |
|---|---|---|---|
| 3,103,399 | 9/1963 | Martin | 339/105 X |
| 3,192,500 | 6/1965 | West | 339/186 M X |
| 3,864,011 | 2/1975 | Huber | 339/103 M |
| 3,924,915 | 12/1975 | Conrad | 339/17 F |
| 4,037,906 | 7/1977 | Jayne | 339/107 |
| 4,269,466 | 5/1981 | Huber | 339/107 |

*Primary Examiner*—Eugene F. Desmond
*Attorney, Agent, or Firm*—Adrian J. LaRue

[57] ABSTRACT

An electrical connector for flat transmission cable comprises a body member having terminal-receiving passageways and conductor-receiving passageways. Electrical terminals are disposed in the terminal-receiving passageways for terminating electrical conductors of a flat transmission cable which are disposed in respective conductor-receiving passageways. Cover members are secured onto the body member and they include strain relief members engaging the flat transmission cable and the respective electrical conductors. According to another aspect of the present invention, the cover members include projections that are disposed on each side of the conductor-receiving sections of the electrical terminals to prevent the electrical conductors from disconnecting from the conductor-receiving sections.

18 Claims, 11 Drawing Figures

FLAT TRANSMISSION CABLE CONNECTOR AND HOUSING THEREFOR

FIELD OF THE INVENTION

This invention relates to electrical connectors and more particularly to electrical connectors for connection with the conductors of flat transmission cable.

BACKGROUND OF THE INVENTION

U.S. Pat. No. 4,269,466, the disclosure of which is hereby incorporated herein by reference, discloses an electrical connector for flat transmission cable, but the strain relief for the cable is inadequate, particularly when the width of the cable is increased by the addition of more conductors. Moreover, the stresses and strains the flat transmission cable undergoes can cause some of the conductors to become disconnected from their respective electrical terminals and possibly short with other conductors or terminals.

U.S. Pat. No. 3,864,011, the disclosure of which is hereby incorporated herein by reference, discloses a metal strain relief as part of an electrical connector for flat transmission cable which is not acceptable due to possible shorting when the signal conductors become disconnected from their respective electrical terminals and engage the metal strain relief or due to elongation of the signal conductors causing them to short against the metal strain relief.

SUMMARY OF THE INVENTION

According to the present invention, an electrical connector for flat transmission cable comprises a body member having terminal-receiving passageways and conductor-receiving passageways. Electrical terminals are disposed in the terminal-receiving passageways for terminating electrical conductors of a flat transmission cable which are disposed in respective conductor-receiving passageways. Cover members are secured onto the body member and they include strain relief members engaging the flat transmission cable and the respective electrical conductors.

According to another aspect of the present invention, the cover members include projections that are disposed on each side of the conductor-receiving sections of the electrical terminals to prevent the electrical conductors from disconnecting from the conductor-receiving sections.

According to a further aspect of the present invention, a housing member receives matable electrical connectors therein in a polarized manner for electrical connection therein. Latch members are movably mounted on the housing member to latchably secure the matable electrical connectors in the housing member.

DETAILED DESCRIPTION OF PREFERRED EMBODIMENTS

Figure 1:
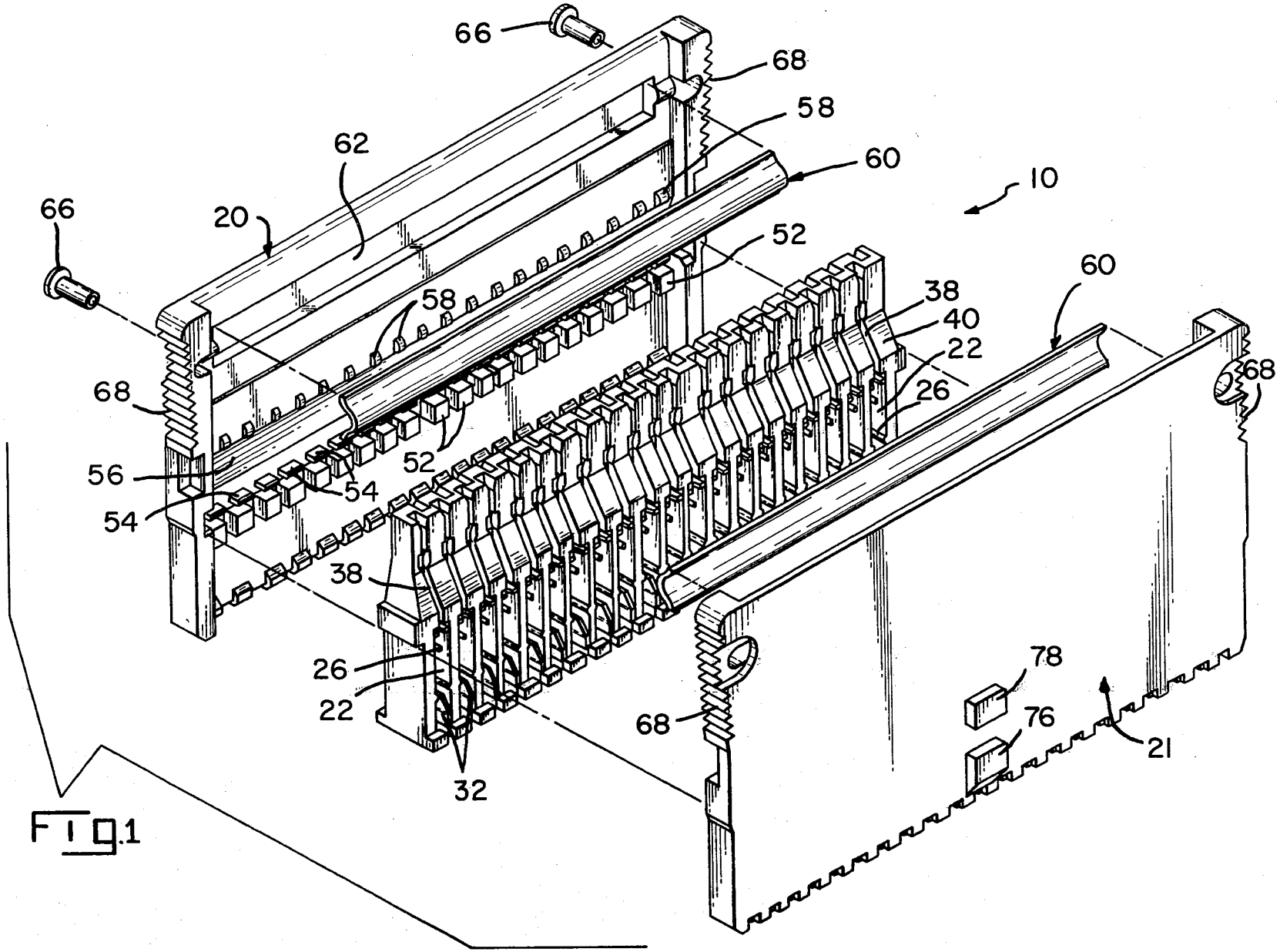
FIG. 1 is a perspective exploded view of parts of the electrical connector.

FIGS. 1–6 illustrate flat transmission cable connector 10 for terminating signal conductors 12 and drain conductors 14 of flat transmission or ribbon coax cable 16 which is disclosed in U.S. Pat. No. 3,775,552, the disclosure of which is hereby incorporated herein by reference. Connector 10 comprises a body member 18 and cover members 20, 21 which are molded from a suitable plastic material.

Body member 18 includes a series of terminal-receiving passageways 22 on each side thereof and in which electrical terminals 24 are disposed. Each passageway 22 includes projections 26 in opposing surfaces which meet with corresponding recesses 28 in a body section 30 of terminal 24 to properly position electrical terminal 24 within passageway 22. A post-engaging section 32 of electrical terminal 24 is in alignment with a beveled opening 34 at the front end of body member 18. A conductor-terminating section 36 of terminal 24 is in alignment with a conductor-receiving passageway 38 in which conductors 12 or 14 are positioned for electrical termination with conductor-terminating section 36. Conductor-receiving passageways 38 are beveled at their entrances to facilitate the positioning of conductors 12, 14 therein. Sloped surfaces 40 are located on each side of body member 18 along passageways 38. Arcuate recesses 42 are disposed in each of passageways 38 adjacent sloped surfaces 40 and they extend inwardly beyond the bottom surfaces of passageway 38. As can be discerned from FIGS. 3 and 5, the bottom surfaces of passageways 38 have sloped surfaces 44, arcuate recesses 42 and flat surfaces 46 along which conductors 12, 14 extend.

Thus, cable 16 is stripped baring conductors 12, 14 which are then positioned within respective passageways 38 and terminated in conductor-terminating sections 36 of electrical terminals 24 in accordance with conventional terminating techniques. Thereafter, cover members 20, 21 are secured in place on body member 18.

Figure 3:
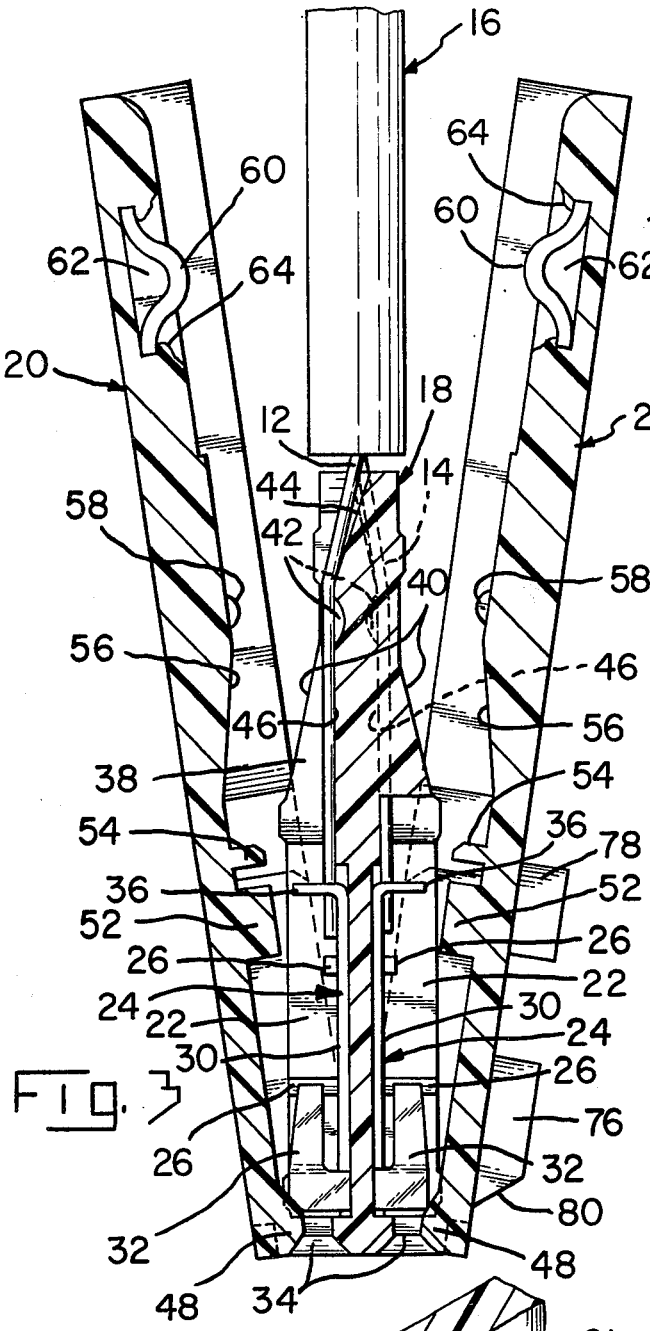
FIG. 3 is a cross-sectional view showing the electrical conductors of the flat transmission cable terminated to the electrical terminals and the cover members in a partly-closed position.
Figure 4:
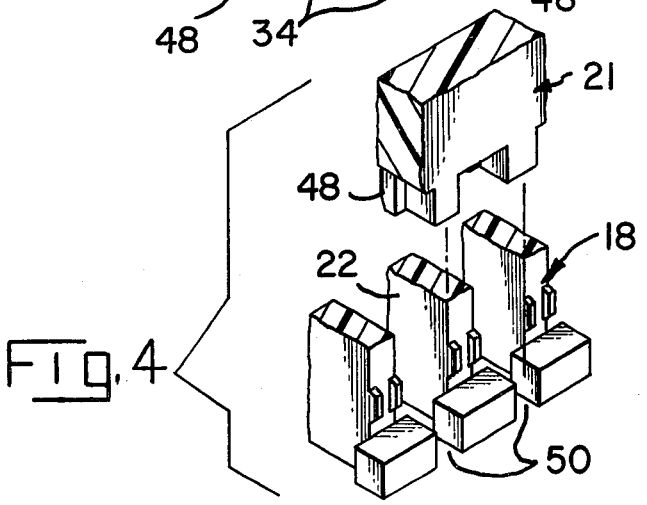
FIG. 4 is a perspective exploded view of front parts of the body member and a cover member prior to matable engagement therebetween.
Figure 5:
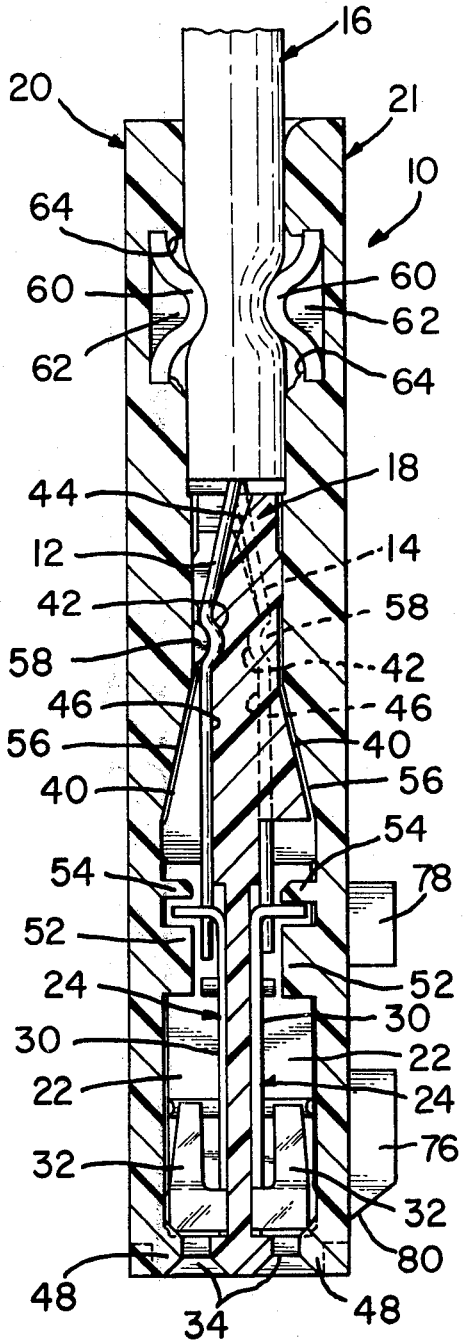
FIG. 5 is a view similar to FIG. 3 showing the cover members in a closed position.

Each of cover members 20, 21 have T-shaped sections 48 at the front end thereof which are disposed in respective passageways 22 and matable within recesses 50 as shown in FIGS. 3–5. Sections 48 complete the outer ends of beveled openings 34 and define pivots about which cover members 20, 21 move when being positioned onto body member 18. Spaced projections 52, 54 extend inwardly from the inside surface of cover members 20, 21 and they are disposed on each side of respective conductor-terminating sections 36 when the cover members are secured in position on body member 18 to maintain conductors 12, 14 in position in conductor-terminating sections 36. Beveled surfaces 56 extend along sloped surfaces 40 and arcuate projections 58 engage conductors 12, 14 deforming them into arcuate recesses 42 when cover members 20, 21 are secured in position thereby defining a strain relief for conductors 12, 14 to maintain them in position in passageways 38 and in a terminated position within conductor-terminating sections 36 when stresses and strain occur during the handling of cable 16. Alternatively, projections 58 can be in passsageways 38 and recesses 42 can be located in cover members 20, 21.

Figures 2, 6:
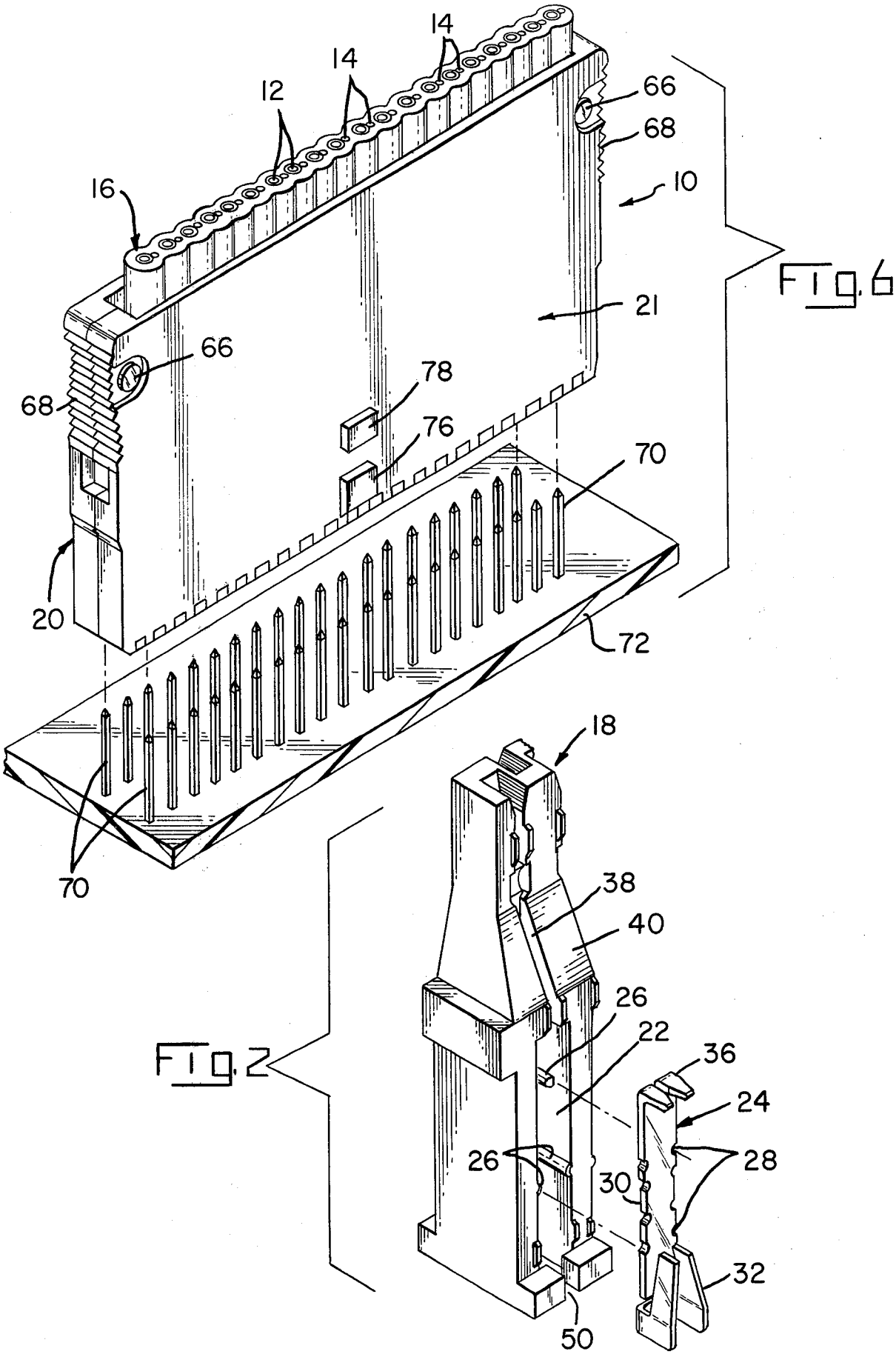
FIG. 2 is a perspective view of part of the body member of the electrical connector with an electrical terminal exploded from its terminal-receiving passageway.
FIG. 6 is a perspective view of the terminated electrical connector exploded from the pins on a printed circuit board intended for connection therewith.
Figure 7:
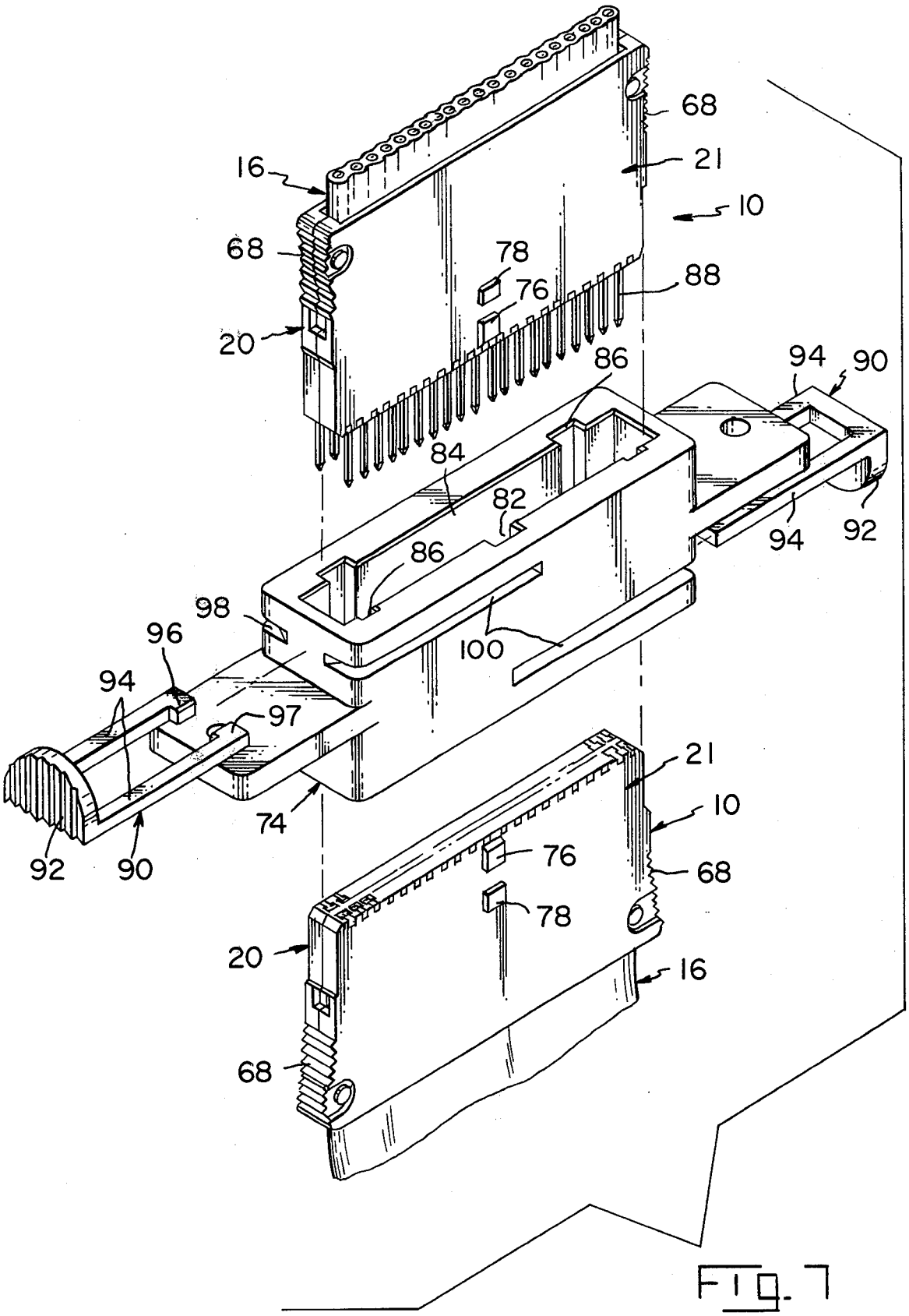
FIG. 7 is an exploded perspective view of matable electrical connectors and a housing member therefor.

U-shaped strain relief members 60 which are formed of metal such as, for example, stainless steel are positioned in recesses 62 in cover members 20, 21 and they are secured therein by areas 64 of the cover members that are deformed onto members 60 after they have been positioned in recesses 62. As illustrated in FIG. 5, strain relief members 60 engage cable 16 when cover members 20, 21 are secured onto body member 18 via rivets 66 thereby forming a strain relief when stresses and strains are applied to cable 16. Cover members 20, 21 are provided with serrations 68 along the sides to form a gripping area when connector 10 is inserted onto posts 70 positioned on printed circuit board 72 or removed therefrom as shown in FIG. 6 or when matable electrical connectors 10 are connected together within a housing member 74 as illustrated in FIG. 7.

Cover members 21 of connectors 10 are provided with projections 76, 78 which are spaced from one another. The leading edge of projections 76 is a beveled surface 80. Projections 76, 78 define polarizing members for matable engagement within recess 82 in connector-receiving passageway 84 of housing member 74. Other recesses 86 are disposed in housing member 74 in communication with passageway 84 to accommodate other connectors. One of connectors 10 has electrical terminals 24 secured therein, whereas the other connector 10 has electrical terminals provided with post members 88 for electrical connection with electrical terminals 24 when the electrical connectors 10 are connected together within housing member 74 which contains mounting members 75 for mounting onto a panel, housing member, or the like.

Electrical connectors 10 are latchably secured within housing member 74 by latching members 90 which include an actuating member 92 and flexible leg members 94, extending outwardly therefrom. Each leg member 94, has an inwardly-directed lug 96, 97 respectively, which is provided with beveled edges. Latching members 90 can be molded from a suitable plastic material or stamped from a suitable metal so long as the leg members 94, have proper operational flexibility.

Figure 8:
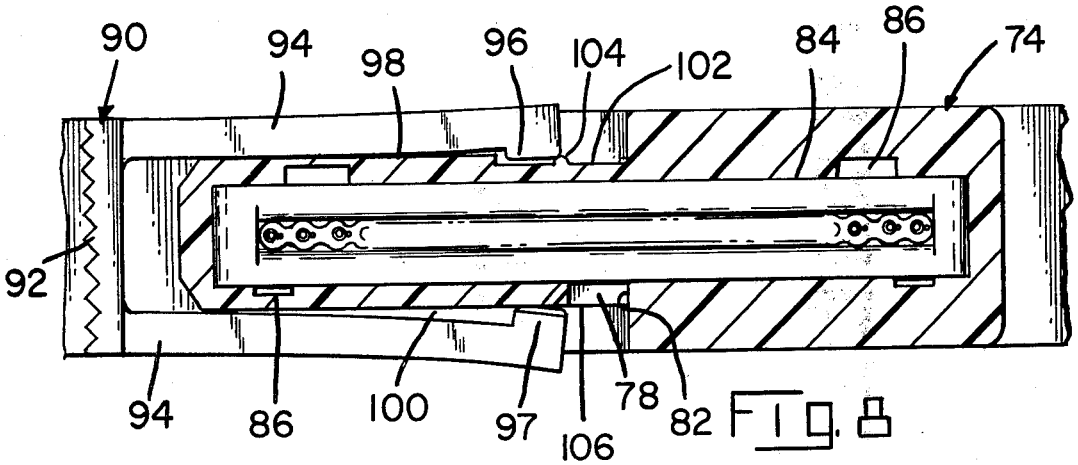
FIG. 8 is a cross-sectional view of FIG. 7 showing the latch member in an unlatched position.
Figure 9:
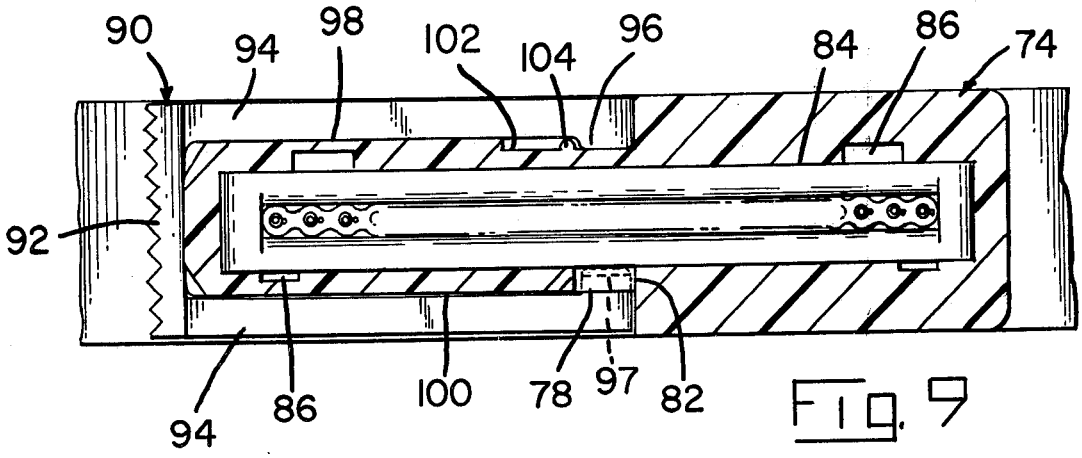
FIG. 9 is a view similar to FIG. 8 showing the latch member in a latched position.

Leg members 94, are disposed in respective slots 98, 100 in the body member of housing member 74 and the entrances thereto have curved surfaces to facilitate movement of lugs 96, 97 therealong. The inner end of slot 98 includes a recess 102 in communication therewith which includes an arcuate projection 104 therein. The inner end of slot 100 has an opening 106 in communication therewith and with recess 82 to enable lug 97 of leg 94 disposed in slot 100 to extend thereinto as illustrated in FIG. 9. Latching members 90 are normally positioned in their inward positions with actuating members 92 in engagement with housing member 74 with legs 94, respectively disposed in slots 98, 100 with lug 96 at the innermost position of recess 102 and inwardly-directed lug 97 is disposed within opening 106 as illustrated in FIG. 9. Connectors 10 can then be positioned within passageway 84 of housing member 74 with projections 76, 78 moving along recess 82 with beveled surfaces 80 of projections 76 camming lugs 97 out of opening 106 until lugs 97 reach the space between projections 76, 78 whereby they move thereinto thereby latching connectors 10 in position in housing member 74. When connectors 10 are to be disconnected from each other, latching members 90 are moved to the position as shown in FIG. 8 via actuating members 92 with lug 96 disposed in recess 102 to the left of arcuate projection 104 and lug 97 being located along the inner surface of slot 100 thereby permitting removal of connectors 10 from housing member 74. Thus, connectors 10 can be interconnected within housing member 74 with latching members 90 in a latching position as illustrated in FIG. 9 and are removable from housing member 74 by movement of latching members 90 to their non-latching positions as illustrated in FIG. 8.

Figure 10:
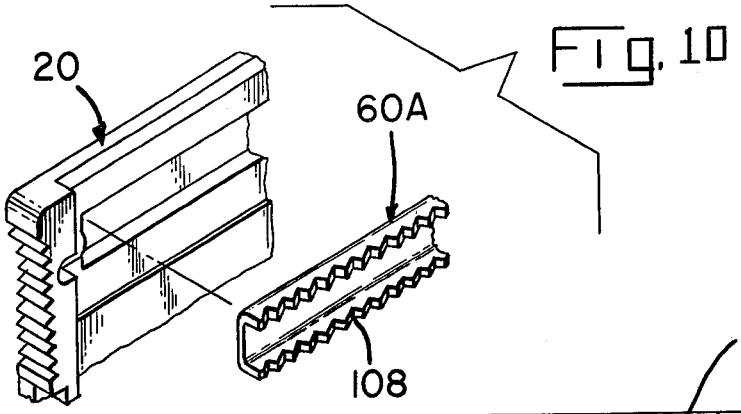
FIG. 10 is a perspective view of part of a cover member with an alternative cable strain relief member exploded therefrom.
Figure 11:
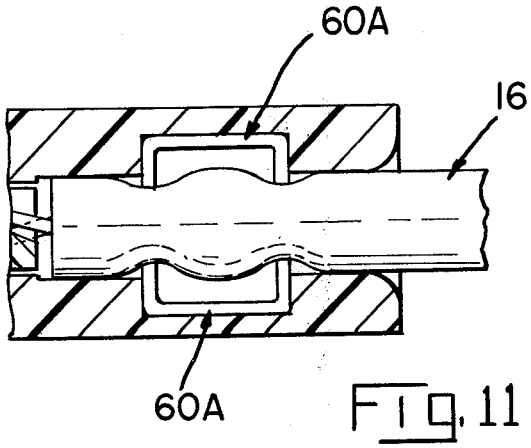
FIG. 11 is a cross-sectional view showing the cable strain relief members of FIG. 10 in operation.

FIGS. 10 and 11 illustrate an alternative embodiment of strain relief members 60A which are provided with serrated edges 108 for biting engagement with the outer jacket of the ribbon coax cable 16 as illustrated in FIG. 11.

I claim:

1. An electrical connector for flat transmission cable including signal conductors and drain conductors, the electrical connector comprises a body member having terminal-receiving passageways and conductor-receiving passageways in respective communication therein, electrical terminals disposed within the terminal-receiving passageways and having conductor-terminating sections, and cover members securable onto the body member, characterized in that said cover members have projection members in alignment with corresponding recesses in said conductor-receiving passageways, said projection members deforming the respective conductors into said corresponding recesses when the conductors are disposed in said conductor-receiving passageways and said cover members are secured onto said body member thereby providing strain relief for the conductors.

2. An electrical connector as set forth in claim 1 characterized in that said cover members comprise spaced projections extending inwardly from inside surfaces of said cover members for disposition on each side of said conductor-terminating sections for maintaining the sections of the conductors terminated in the conductor-terminating sections therein.

3. An electrical connector as set forth in claim 1 characterized in that cable strain relief members are provided on inside surfaces of said cover members for engagement with the cable when said cover members are secured on said body member.

4. An electrical connector as set forth in claim 3 characterized in that said cable strain relief members comprise U-shaped members having legs secured in recesses in said cover members and bights thereof engageable with the cable.

5. An electrical connector as set forth in claim 3 characterized in that said cable strain relief members comprise U-shaped members having bights thereof secured in recesses in said cover members and legs thereof having serrated edges engageable with the cable.

6. An electrical connector for flat transmission cable including signal conductors and drain conductors comprising:

body means having terminal-receiving passageways and conductor-receiving passageways in respective communication therein;

electrical terminal means disposed in said terminal-receiving passageways and having conductor-terminating sections for terminating respective sections of the signal and drain conductors positioned in said conductor-receiving passageways;

cover members mountable on and adapted to be secured onto said body member and extending along said terminal-receiving and conductor-receiving passageways and an end of the cable; and strain relief means in said conductor-receiving passageways and on said cover members for engaging the conductors thereby providing strain relief for the conductors.

7. An electrical connector as set forth in claim 6 wherein said strain relief means comprise recesses in said conductor-receiving passageways and projections extending outwardly from an inside surface of said cover members in alignment with respective ones of said recesses.

8. An electrical connector as set forth in claim 6 and further comprising cable strain relief means on said cover members for engagement with the cable.

9. An electrical connector as set forth in claim 8 wherein said cable strain relief means comprise U-shaped members secured in recesses in said cover members.

10. An electrical connector as set forth in claim 9 wherein legs of said U-shaped members are secured in said cover member recesses and bights thereof engage the cable.

11. An electrical connector as set forth in claim 9 wherein bights and sections of legs of said U-shaped members are secured in said cover member recesses and serrated edges of the legs engage the cable.

12. An electrical connector as set forth in claim 6 and further comprising spaced projections extending outwardly from inside surfaces of said cover members for disposition on each side of said conductor-terminating sections for maintaining the sections of the signal and drain conductors terminated in said conductor-terminating sections therein.

13. A housing member for housing electrical connectors interconnected together therein and latchably securing them therein, said housing member comprising:

a body member having a passageway extending therethrough for receiving the electrical connectors therein, said body member having slot means therein, one of said slot means having an opening therein in communication with said passageway, the other of said slot means having a recess;

latching means including flexible leg means extending respectively along said slot means and having inwardly-directed lug means disposed respectively in said recess and through said opening, said lug means in said opening latchably securing the electrical connectors in said passageway by latching-member means on the electrical connectors.

14. A housing member as set forth in claim 13 wherein said passageway includes recess means in alignment with said opening along which the latching-member means moves thereby defining polarizing means.

15. A housing member as set forth in claim 13 wherein said recess includes a projection to maintain said lug means in said recess in one position so that said lug means is maintained in said opening and said projection maintains said lug means in another position in said recess so that said lug means is positioned in said slot means outside said opening.

16. A housing member having a passageway therethrough for receiving matable electrical connectors in electrical connection therein, characterized in that said housing member has slots extending inwardly from sides thereof to about midway thereof and a recess in said passagewy, one of said slots having a recessed area therein, said housing member having an opening in communication with said recess and said recessed area;

latching members including leg members slidably disposed in respective ones of said slots, said leg members having inwardly-directed lugs disposed respectively in said recessed area and said opening with the lug in said opening latchably securing the mated electrical connectors in said passageway by latching members on the electrical connectors.

17. A housing member as set forth in claim 16 characterized in that said recess and said latching members define polarizing members.

18. A housing member as set forth in claim 16 characterized in that said recessed area has a projection so that said lug in said recessed area on one side of said projection maintains said lug in said opening therein and said lug in said recessed area on the other side of said projection maintains said lug outside of said opening and disposed in said slot.

* * * * *